United States Patent [19]

Kaneko et al.

[11] 3,949,552

[45] Apr. 13, 1976

[54] HEAT INSULATING CASTINGS

[75] Inventors: Yasuhisa Kaneko; Akiyoshi Morita; Yasuo Nemoto; Junichi Nagataki, all of Toyota, Japan

[73] Assignee: Toyota Jidosha Kogyo Kabushiki Kaisha, Japan

[22] Filed: Dec. 13, 1973

[21] Appl. No.: 427,017

[30] Foreign Application Priority Data

July 9, 1973 Japan ..... 48-77218

[52] U.S. Cl. ..... 60/282; 29/187.5; 123/193 H; 123/188 M; 123/193 R; 138/149

[51] Int. Cl.[2] ..... F01N 3/10; F01N 7/18

[58] Field of Search.... 29/187.5; 123/193 R, 193 H; 138/149; 60/282

[56] References Cited

UNITED STATES PATENTS

| | | | |
|---|---|---|---|
| 3,709,772 | 1/1973 | Rice | 60/282 X |
| 3,724,218 | 4/1973 | Cole | 60/282 |
| 3,750,403 | 8/1973 | Deutschmann | 60/272 |
| 3,786,795 | 1/1974 | Kaneko | 123/193 H |

FOREIGN PATENTS OR APPLICATIONS

| | | | |
|---|---|---|---|
| 680,613 | 1/1930 | France | 60/272 |
| 524,182 | 7/1940 | United Kingdom | 60/272 |

*Primary Examiner*—Wendell E. Burns
*Attorney, Agent, or Firm*—Connolly and Hutz

[57] ABSTRACT

The present invention relates to heat insulating castings of triple structure consisting of heat and corrosion resistant metal, heat insulating refractory material, and cast metal. The invention is characterized in that heat and corrosion resistant metal sheet is covered with heat insulating refractory material and the thus formed assembly is enveloped with cast metal. Fringe areas are provided at the ends of the heat and corrosion resistant metal and these fringes are enveloped with cast metal.

7 Claims, 9 Drawing Figures

Fig. 1.
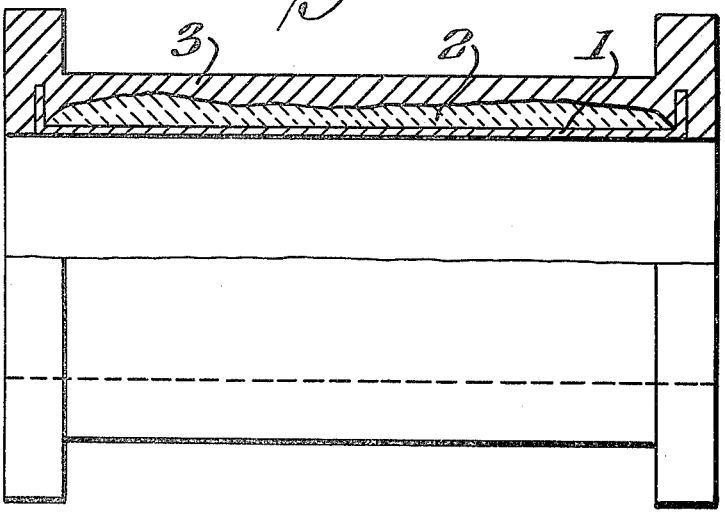
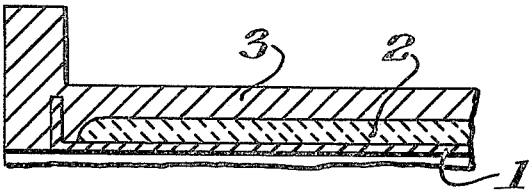
Fig. 2A.
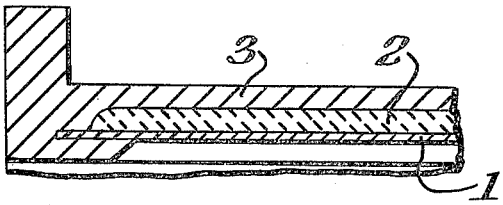
Fig. 2B.
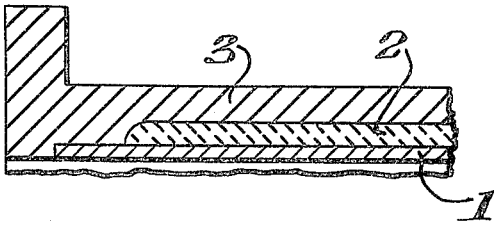
Fig. 2C.
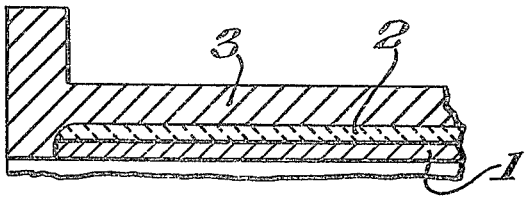
Fig. 2D.

HEAT INSULATING CASTINGS

BACKGROUND OF THE INVENTION

In the conventional practice of enhancing the heat insulating ability of castings, a piece of heat and corrosion resistant steel is sometimes inserted into a pipe after the latter has been cast. In this case, an air layer is formed between the casting and the steel lining or a heat insulator is inserted. According to another method, a ceramic core lining is provided and the entire assembly is enveloped with a casting to make it a double structure.

The former method is subjected to restrictions when the cast product has a complicated profile, while the latter method is not suitable for the cast product required to be durable and stable in quality, because of the weakness of ceramics to vibrations and heat shock under repeated cycles of heating and cooling.

SUMMARY OF THE INVENTION

The heat insulating castings of triple structure according to the present invention are heat insulating, durable under high temperatures, resistant to vibrations and heat shocks under cold-hot cycles, and easy to produce with little variance in quality and high dimensional precision. The heat insulating castings according to the present invention are applicable as parts that serve to convey various high temperature gases, liquids or powders. Use of these castings as parts in the exhaust system of an internal combustion engine enable reduction of harmful emissions.

In accordance with the present invention a heat insulating casting of triple structure comprises a heat corrosion resistant metal sheet with a heat insulating refractory material covering a significant portion of the sheet to thereby form a double structure. A cast metal envelops the thus formed double structure so that the refractory material is completely sandwiched between the metal sheet and the cast metal and does not appear on the surface of the casting. A fringe area is provided at the end of the metal sheet, and the fringe area is enveloped with the cast metal.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which:

FIG. 1 is a longitudinal sectional view of a pipe in an exhaust system;

FIGS. 2A–2D show four variations of the end structure of the pipe shown in FIG. 1;

DETAILED DESCRIPTION OF THE INVENTION

Figure 3:
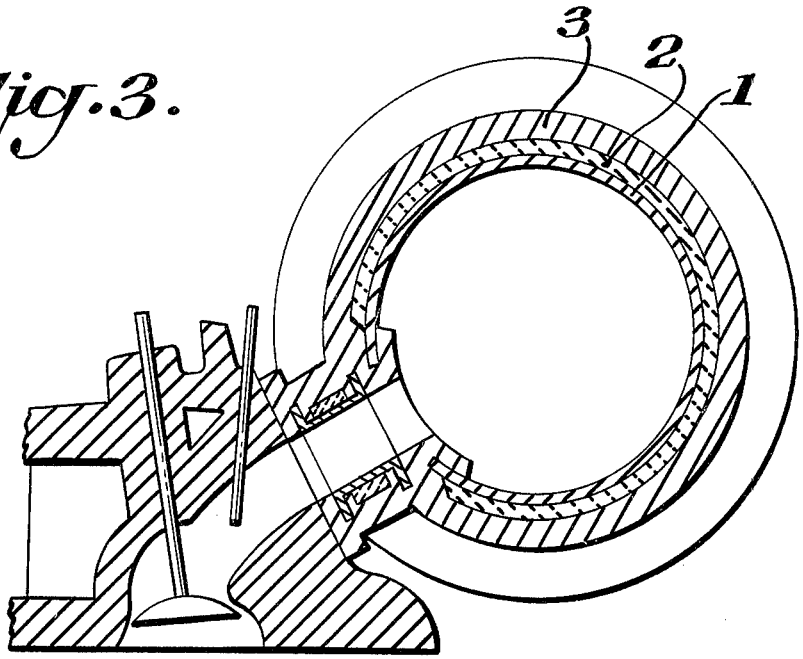
FIG. 3 is a cross-sectional view of a thermal reactor (reactive manifold) of an internal combustion engine.

The present invention relates to heat insulating castings of triple structure consisting of heat and corrosion resistant metal 1, heat insulating refractory material 2, cast metal 3. These castings are characterized by excellence in heat insulation and high temperature durability. To prevent deterioration of the triple structure, such as tear-off under unfavorable conditions of repeated long cold-hot cycles, the fringes at both ends of the heat and corrosion resistant metal 1 are covered with cast metal in a unique construction. Products of complicated profiles are obtained with the castings of the present invention, and these products are characterized by high durability, especially under vibrations and shocks due to repetition of cold-hot cycles, easiness of production and high dimensional precision with little variance in quality.

The product of the present invention is applicable as parts in the exhaust system of an internal combustion engine for removal of harmful gases. Such parts made of heat and corrosion resistant castings according to the present invention prevent temperature drop in the hot gases flowing therein and help burn out harmful components such as CO, HC.

Specific applications of the product of this invention include: the exhaust port in a cylinder head; the branch and the interior of a thermal reactor (reactive manifold); and exhaust piping. The applicabilities of the present invention extend not only to these parts in the exhaust system of an internal combustion engine, but also to other parts through which various hot gases, liquids or powders flow.

Referring to the attached drawings, the structure of the heat insulating castings according to the present invention is to be described in the example of a pipe. FIG. 1 shows a heat insulation pipe which is lined with an inside core 1 made of a thin sheet of metal with excellent resistance to heat and corrosion. A heat insulating refractory material 2 with good heat insulation covers the core 1 thus forming a double structure. This double structure is cast in an envelope of cast metal 3 thereby providing a triple structure. The inside core 1 is made of a heat and corrosion resistant steel sheet the grade and thickness of which are selected to match the service conditions. The core 1 may be integrally formed by well known forming techniques or it may be formed by welding two or more sections together into a single unit. The heat insulating refractory materials 2 available include molten silica ($SiO_2$), zircon sand ($ZrSiO_4$), alumina ($Al_2O_3$) and other ceramics. These materials are attached to the surface of the steel sheet 1 by means of a binding agent or some form of mechanical means. The double structure thus formed is inserted in the core and cast-enveloped with molten metal from outside.

Cast metal 3 is a casting material and is selected from cast iron, aluminum and other casting alloys.

FIGS. 2A–2D illustrate various structures at the end of the inside core 1 of heat and corrosion resistant metal. For the heat insulating castings of the present invention, the structures in FIGS. 2A and B were adopted while the structures of FIGS. 2C and D were found unsuitable. The structure of FIG. 2A is formed by cutting a notch at the end of the heat and corrosion resistant metal sheet and bending it upwardly or by providing a welded fringe perpendicular to the metal sheet. The structure of FIG. 2B is a sandwich structure formed at the end of the metal sheet with cast metal. The structure of FIG. 2C represents a longer end of the heat and corrosion resistant metal sheet than that of the heat insulating castings. Here only one side of the end of the metal sheet comes into contact with the cast metal. FIG. 2D represents a cast-envelope 2 of heat insulating refractory material and the metal sheet has a length equal to the cast-envelope 2. The construction of FIG. 2D is not suitable for the heat insulating castings of the present invention.

Specific embodiments of the present invention are discussed below.

EXAMPLE 1

An inside core 1 as shown in FIG. 1 was made of a 1.0 mm sheet of JIS SUS27 (Fe-18% Cr-8%Ni) and three kinds of end structures (FIGS. 2A, 2B, 2C) were produced. In the case of FIG. 2A, two variations were prepared: one (*a*-1) with a 4 mm high fringe area welded at the end and another (*a*-2) bent after being notched to thereby form a 4 mm high fringe area.

The heat insulating refractory material 2 to be built up on the outside of the inside core 1 was 25-mesh molten silica, which was laid on a stainless pipe to a thickness of 3.0±0.5 mm and fully dried. The cast metal 3, with which to envelope the double structure thus obtained, was JIS FC25, which was built up to a thickness of about 5 mm.

In the structures *a*-1, *a*-2, and FIG. 2B, an alloy layer was locally formed at the interface of the heat and corrosion resistant steel SUS27 and the cast metal FC25, and partially, the thickness amounted to about 50 – 100$\mu$, but it caused no particular trouble.

In the structure of FIG. 2C, the alloyed layer was partially recognized, but it did not represent any alloyed bond between SUS27 and FC25 but only a mechanical joint. Positioning for cast-enveloping of a core was performed at the end.

Positioning in the structures *a*-1, *a*-2, and FIG. 2B was easily and accurately carried out at the end of stainless steel. Positioning in the structure of FIG. 2C was inaccurate with a variance in the thickness of heat insulating material. The cast product shown here is a part of the exhaust pipe for an internal combustion engine.

To test the heat insulating effect, a cast pipe of JIS FC25, 9.5 mm in wall thickness, with no heat insulating material provided but of the same profile was prepared and put to a burner evaluation test.

In the test, the inside surface of the pipe was heated by a gas burner at 1000°C. and the temperature on the outside surface at mid-pipe was measured. The results were the inside surface temperature 950°C. and the outside surface temperature 490°C. at mid-pipe in the structures *a*-1, *a*-2, and FIG. 2B. Meanwhile, in the case of an all-cast pipe, the inside surface temperature was 950°C. and the outside surface temperature 550°C. Thus, the outside surface temperature of the invented structure was about 60°C. lower than that of the conventional structure.

Next, to determine durability the structures *a*-1, *a*-2, and FIG. 2B were submitted to repeated cold-hot cycles by a gas burner. In this test, a cycle of heating the pipe inside by a propane gas burner at 950°C. for 20 minutes, then quenching it with water, and 10 minutes thereafter reheating it, was repeated. At the 25th cycle, the structure of FIG. 2C was torn off, revealing molten silica inside and deformation of the stainless steel. By contrast, the structures *a*-1 and *a*-2 showed nothing wrong. Thereupon, another 25 cycles of cooling and heating were repeated, but no abnormal appearance was observed or any deformation due to strains caused through differences in the coefficient of thermal expansion and the temperature between cast metal and heat and corrosion resistant steel.

EXAMPLE 2

In this example, in one case the thermal reactor (reactive manifold), branch and reactor interior of an internal combustion engine were fabricated of the heat insulating castings while in another case only the branch was fabricated of the heat insulating castings.

Figures 4, 5:
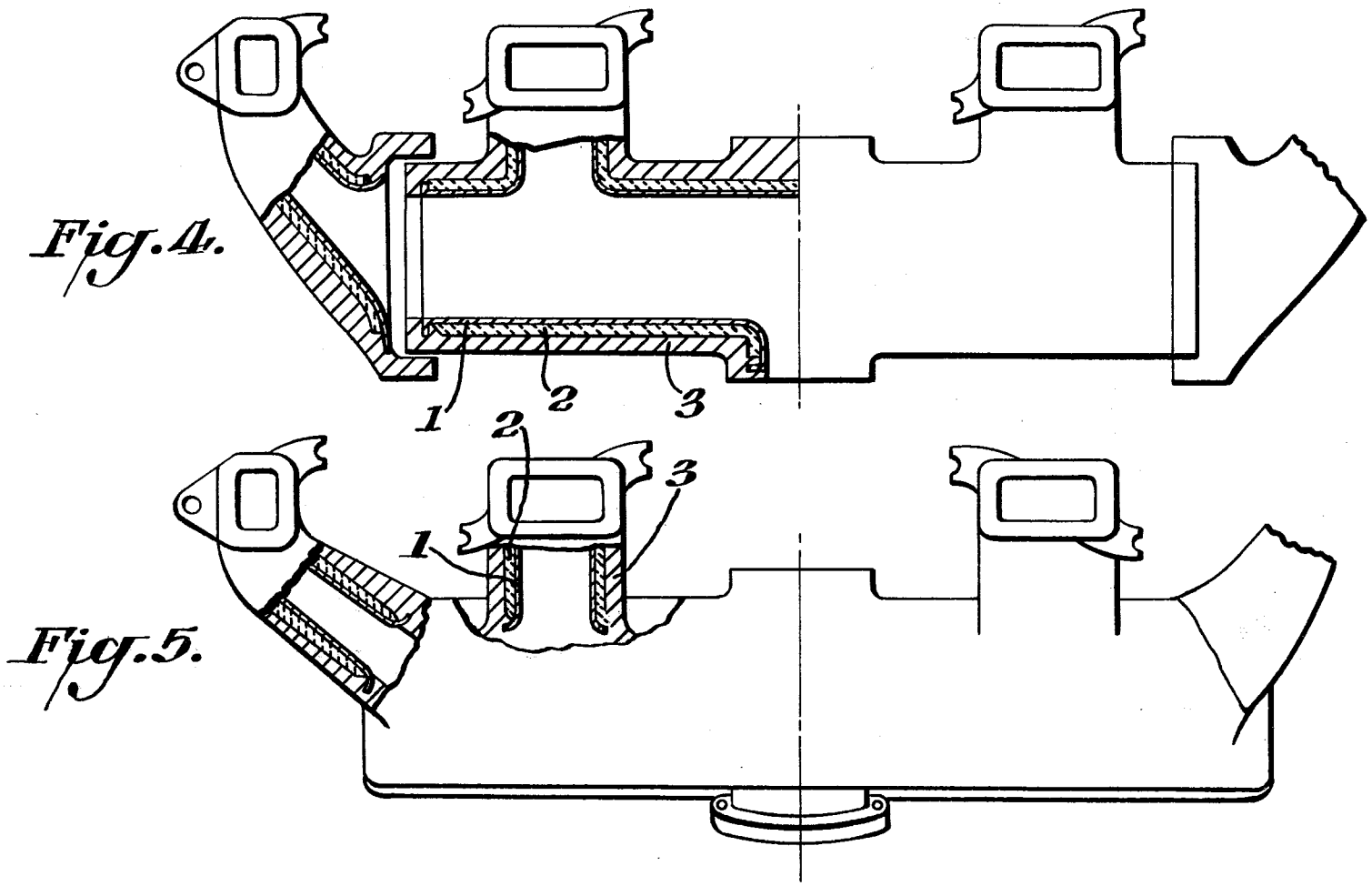
FIG. 4 is a longitudinal sectional view of a manifold reactor whose branch and reactor interior are made of heat insulating castings according to the present invention.
FIG. 5 is a longitudinal sectional view of a manifold reactor in which only the branch is made of heat insulating castings according to the present invention.

FIG. 3 is a cross-sectional view of the manifold reactor, in which the end was designed in a sandwich structure and the thermal reactor was made of the heat insulating castings. FIG. 4 is a longitudinal sectional view of the manifold reactor, in which the branch and the reactor interior were made of the heat insulating castings. FIG. 5 is a longitudinal sectional view of the manifold reactor, in which only the branch was made of the heat insulating castings.

In FIGS. 3–5, the core 1 is made of a 1.0 mm thick sheet of JIS SUS42 (Fe-24%Cr-20%Ni) steel, and represents an integral welded structure of halved sections press-formed. As indicated in each Figure, the end structure was sandwiched or press-formed with a fringe treated thereby.

The heat insulating refractory materials were three: a 25-mesh molten silica built up to a thickness of 3.0±0.5 mm just as in Example 1; a 3.5±0.5 mm thick formation of ceramic fiber (Trade name "Kao wool"), wound with a fine steel wire; and a formation set in a shell metal mold and deposited with shell sands to a thickness of 3.0 mm.

Cast metal 3 was JIS FC 25 built up to a thickness of about 4 mm. Positioning was made invariably at the end of stainless steel. The end had always been alloyed.

To test the heat insulating effect, a reactor as illustrated in FIG. 5 was produced in which only the branch was made of the heat insulating castings by covering a molten silica to a thickness of 3.5±0.5 mm on the outside surface of 1.0 m thick JIS SUS 42 stainless sheet and then enveloping it with the cast metal Fe 25 to a thickness of 4 mm.

On the other hand, another reactor of similar structure using the cast metal FC 23 and built-up to a wall thickness of 8.5 mm, with no heat insulating refractory material employed, was produced and submitted to the same burner evaluation test as in Example 1.

The outside surface temperature of the branch designed in the invented structure was 480°C. under an internal gas temperature of 950°C., whereas that of the branch of the other structure was 600°C. under an internal gas temperature of 950°C. Thus, adoption of the invented structure reduced the outside surface temperature by 120°C.

Meanwhile, the gas temperature at the center of the reactor core turned out 950°C. in the reactor with the branch designed in the invented structure, while it was 900°C. in a common reactor thereby showing a rise of about 50°C. in the internal temperature. The exhaust gas temperature at the reactor outlet was 850°C. in the invented structure, but it was 800°C. in the conventional structure. As for the harmful components of CO and HC in the exhaust gases, the above-mentioned temperature rise brought about removal of these components to a corresponding extent. The reductions of these components were about 15% for CO and about 10% for HC in the reactor with the branch of the invented structure, as compared with the conventional reactor. The same tendency was observed with the case of not only the branch, but the whole part being designed in the invented structure. As compared with the conventional structure, the reductions of CO, HC were about 20% and 15%, respectively.

Next, for the evaluation of durability two reactors, one with only the branch designed in the invented structure shown in FIG. 2A, and one of the conventional structure shown in FIG. 2D, were submitted to cold-hot cycle tests using a bench engine. In these tests, a 10-minute operation wherein the engine being under such a partial load that the reactor inside attained a gas temperature of 950°C., was followed by 5 minutes of cooling the reactor inside at a temperature of about 100°C. by motoring; and again the temperature was raised, this cycle being repeated.

After the 50th cycle, the reactor was dismounted from the engine and inspected. Thereupon, the reactor of the structure including the FIG. 2A branch showed nothin wrong, but the one of the structure including the FIG. 2D branch was found torn off at the end with SUS 42 deformed and the internal heat insulating refractory material broken into pieces.

The structure including the FIG. 2A branch was again mounted on the engine and put to another 50 cycles of cooling and heating, but even after this, nothing particularly wrong was revealed. Meanwhile, after 400 hours of a routine bench test, nothing particularly wrong was noted.

The routine bench test was performed in an oxidizing atmosphere by holding the inside core temperature of the reactor center at 970°C.

On the other hand, a reactor with the branch and all the other parts fabricated of heat insulating castings and including the structure of FIG. 2A, and one similarly fabricated but including the structure of FIG. 2D were submitted to the same cold-hot cycle test as above. The results showed that the one including the structure of FIG. 2A suffered no tear-off of the end and developed a local deformation due to expansion, which proved to offer no inconvenience for practical use and exhibited nothing wrong in other respects either. By contrast, the one including the structure of FIG. 2D was heavily deformed with a torn end and the internal heat insulating refractory material broken into pieces. After 400 hours of the routine bench test, the one including the structure of FIG. 2A developed no tear-off of end, but showed a barely visible degree of deformation due to expansion, which, however, was not so serious as to hamper practical use, whereas in the one including the structure of FIG. 2D a torn end occurred with heavy deformation and breaking apart of the refractory material.

EXAMPLE 3

Figure 6:
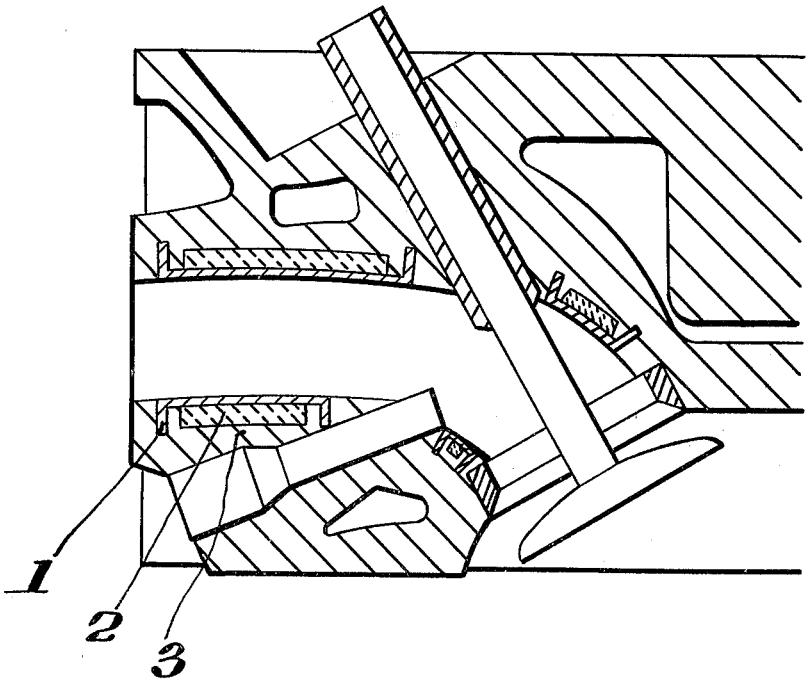
FIG. 6 is a sectional view of the cylinder head of an internal combustion engine made of heat insulating castings.

This is a case of the cylinder head in an auto gasoline engine being fabricated of the heat insulating castings according to the present invention. FIG. 6 is a sectional view of the cylinder head in which the core 1 is represented by an integration of halved sections by press-forming of Inconel 600 (Ni-15%Cr-7%Fe-0.8%Al) 0.8 mm thick, the end structure having a 3 mm fringe as illustrated. The same heat insulating refractory material 2 as in Example 1 was employed. The cast metals 3 used were aluminum alloy JIS AC 4B and common cast iron JIS FC 25. The end fabricated of FC 25 had been alloyed and bonded, but the one fabricated of AC 4B had not been alloyed.

When the cast-envelope was AC 4B, the bonded degree was improved when the surface had been plated with zinc or copper for better affinity between aluminum alloy and Inconel and it had been made active for easy reaction with molten aluminum. The triple structure portion of the castings was set at about 3.0 mm in thickness.

In testing of the heat insulating effect, an engine with the exhaust port of a cylinder head fabricated of JIS AC 4B, 3 mm thick refractory material and 0.8 mm thick heat insulating castings of the present invention exhibited an exhaust gas temperature about 100°C. higher at the exhaust port than the conventional cylinder head in the engine bench test, and emitted the harmful components CO, HC, respectively, about 30% and 15% less.

For the evaluation of durability, under the same conditions as in Example 2, cold-hot cycle tests and 400 hours of routine bench test using the bench engine were carried out. According to the results thereof, both the aluminum alloy one and the cast iron one, when the structure included the FIG. 2A construction, developed nothing particularly wrong, being free from any tear-off at the end. In the case including the structure of FIG. 2D, though no heavy tear-off was observed, minor tear-off of deformation was revealed, but with no serious trouble.

As known from the above results, the heat and corrosion resistant steel in this invention serves, under exposure to a hot, injurious atmosphere of a high temperature fluid, to prevent the corrosion, oxidation and other deteriorations of castings. The material should be selected to suit the intended use with allowance for its formability and weldability. Meanwhile, surface treatment of the integrated formation of heat and corrosion resistant steel with diffusion of Al or Cr will be effective for improvement of resistance to heat and corrosion. Attention should be paid to the thickness of the heat and corrosion resistant steel sheet, because the heat insulating effect of a thick sheet is low, while the durability of a thin sheet is inferior. Otherwise, the thickness of the sheet is restricted by weldability, formability and other material qualities. According to the results of application, the desirable thickness is 0.8 – 1.5 mm.

As for the heat insulating refractory material which serves to preserve the heat by minimizing the heat dissipation from the heat and corrosion resistant steel, a material with low thermal conductivity, light weight and high rate of porosity should be adopted. Molten silica ($SiO_2$) adopted in this example was: 25-mesh apparent density (held with a binder and dried) 1.8 – 2.2 g/cm$^3$, and thermal conductivity 0.003 cal/cm$^{2}$/sec/°C. A refractory material with a thick wall may exhibit a high heat insulating effect, but the manufacturing conditions limit its reasonable thickness to 3 – 5 mm. When the wall thickness exceeds about 5 mm, the heat insulating effect of molten silica tends to drop sharply.

It is obvious that the heat insulating castings of the present invention are characterized by a number of excellent features such as high durability under vibrations and heat shocks due to repeated cycles of cooling and heating, and high heat insulating effect, by virtue of which the harmful components of CO, HC in exhaust gas are reduced.

Further, in the structure according to the present invention, in the casting process of which no refractory material is deposited at the end, the dimensional accuracy of this area depends on the precision of the press-formed product and therefore, a dimensional error of less than ±0.5 mm can be attained even in the presence of a welded part.

Besides, the positioning of a cast-envelope can be made referring to the area with no deposit of a refractory material. Thus, with the dimensional error of the formed product held below ±0.5 mm, the manufacture of the invented structure is easy. On the contrary, in the case of the conventional structure in which the refractory material is deposited or spread up to the end, successful positioning of castings in the mold with high accuracy is impossible, and cast-envelopment in exact position is difficult unless high dimensional accuracy of the refractory material is assured.

What is claimed is:

1. A heat insulating casting of triple structure comprising a heat and corrosion resistant metal sheet with a heat insulating refractory material covering a significant portion of the sheet to thereby form a double structure, a cast metal enveloping the thus formed double structure whereby the refractory material is completely sandwiched between the metal sheet and the cast metal and does not appear on the surface of the casting, and a fringe area at the end of the metal sheet enveloped with the cast metal, the fringe area including an upturned portion spaced from the refractory material and completely enveloped with the cast material.

2. A heat insulating casting as in claim 1 wherein the heat and corrosion resistant steel is stainless steel.

3. A heat insulating casting as in claim 1 wherein the refractory material is selected from the group consisting of molten silica ($SiO_2$), zircon sand ($ZrSiO_4$), and alumina ($Al_2O_3$).

4. A heat insulating casting as in claim 1 wherein the cast metal is selected from the group consisting of cast iron and aluminum.

5. A thermal reactor of an internal combustion engine comprising the heat insulating casting of claim 1.

6. An exhaust port in a cylinder head of an internal combustion engine comprising the heat insulating casting of claim 1.

7. An exhaust pipe of an internal combustion engine comprising the heat insulating casting of claim 1.

* * * * *